US009282807B1

(12) United States Patent
Carpenter

(10) Patent No.: US 9,282,807 B1
(45) Date of Patent: Mar. 15, 2016

(54) EXERCISE REST BREAK STOOL

(71) Applicant: Diana L. Carpenter, Kent, WA (US)

(72) Inventor: Diana L. Carpenter, Kent, WA (US)

( * ) Notice: Subject to any disclaimer, the term of this patent is extended or adjusted under 35 U.S.C. 154(b) by 71 days.

(21) Appl. No.: 14/303,992

(22) Filed: Jun. 13, 2014

(51) Int. Cl.

| | |
|---|---|
| ***A47C 31/00*** | (2006.01) |
| ***A47C 7/62*** | (2006.01) |
| ***A47C 7/00*** | (2006.01) |
| ***A47B 83/02*** | (2006.01) |
| ***A45F 4/02*** | (2006.01) |
| ***A47C 9/00*** | (2006.01) |
| ***A47C 13/00*** | (2006.01) |
| ***A47C 9/10*** | (2006.01) |

(52) U.S. Cl.
CPC ... *A45F 4/02* (2013.01); *A47C 9/00* (2013.01); *A47C 9/105* (2013.01); *A47C 13/00* (2013.01); *A45F 2004/026* (2013.01)

(58) Field of Classification Search
CPC ..... A47C 9/002; A47C 9/00; A47C 4/00; A47C 9/105; A47C 13/00; A45F 4/02; A45F 2004/026
USPC ..... 297/228.13, 188.2, 135, 4, 16.1, 461, 297/440.16
See application file for complete search history.

(56) References Cited

U.S. PATENT DOCUMENTS

| | | | | | |
|---|---|---|---|---|---|
| 669,497 | A * | 3/1901 | Adler | A47C 9/00 | 297/461 |
| 1,344,431 | A * | 6/1920 | Albertie | A47C 4/286 | 248/435 |
| 2,447,391 | A * | 8/1948 | Brandes | A47C 4/283 | 297/135 |
| 2,702,584 | A * | 2/1955 | Williams | A47C 7/42 | 297/124 |
| 3,895,839 | A | 7/1975 | Amato | | |
| 4,098,478 | A | 7/1978 | Spitzke | | |
| 5,356,204 | A * | 10/1994 | McDonough | A47D 1/006 | 297/181 |
| 5,845,962 | A * | 12/1998 | Lin | A47C 4/02 | 248/188 |
| 6,302,095 | B1 * | 10/2001 | Tolley | A47J 37/0704 | 126/201 |
| 6,676,208 | B2 * | 1/2004 | Lu | A47B 83/008 | 297/16.1 |
| 7,118,172 | B1 | 10/2006 | Pattison-Sheets | | |

FOREIGN PATENT DOCUMENTS

| | | | | |
|---|---|---|---|---|
| DE | 102013003746 A1 * | 9/2014 | ..... | A47C 9/002 |

* cited by examiner

*Primary Examiner* — Milton Nelson, Jr.
(74) *Attorney, Agent, or Firm* — Crossley Patent Law

(57) ABSTRACT

An exercise rest break stool provides a stool including a base with foldable legs that are released and locked into an extended position via a lock-release mechanism, an attachable backrest, and two attachable trays, along with a skirt magnetically attached to the base to shield the legs from view during use. The device also includes a backpack to transport the base, the legs, the backrest and the trays on walks and along for other exercise activities for availability of the stool wherever and whenever needed for a rest break.

7 Claims, 5 Drawing Sheets

EXERCISE REST BREAK STOOL

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of exercise rest break stools are in use and are known in the prior art. However, what is needed is an exercise rest break stools that is adaptable and easy to use, but at the same time, has characteristics that have not yet been utilized or conceived as shown in the present invention.

FIELD OF THE INVENTION

The present invention relates to an exercise rest break stool, and more particularly, to an exercise rest break stool that provides features and characteristics above and beyond existing exercise rest break stools that are presently available today.

SUMMARY OF THE INVENTION

The general purpose of the present exercise rest break stools, described subsequently in greater detail, is to provide an exercise rest break stool which has many novel features that results in an exercise rest break stool which is not anticipated, rendered obvious, suggested, or even implied by prior art, either alone or in combination thereof.

The present invention disclosed herein is an exercise rest break stool including a stool that has a disc-shaped base and a plurality of spring-loaded foldable legs attached to the base that are placed into a folded position and an alternate extended and locked position upon the operation of a lock-release mechanism. The device also includes a backrest and a pair of trays attachable to the base, as well as a skirt that can be magnetically attached to the base so that the legs can be shielded from view while the stool is in use. The device also comes with a backpack that holds the base, the legs, the backrest and the trays. The device is devised to encourage an overweight or disabled person to exercise regularly by accommodating the carrying of the device along on walks or for exercise activities so that the device is readily available wherever and whenever needed for a rest break. The device can also be carried along to provide seating while waiting at a bus stop or watching sporting events as well as for camping excursions. The legs have a length of approximately 22 inches to provide a proper seating height and also to accommodate the transporting of the device in the backpack. The total weight of the present device is up to five pounds.

Thus has been broadly outlined the more important features of the present exercise rest break stool so that the detailed description thereof that follows may be better understood and in order that the present contribution to the art may be better appreciated.

DETAILED DESCRIPTION OF THE DRAWINGS

With reference now to the drawings, and in particular FIGS. 1 through 6 thereof, an example of the exercise rest break stool employing the principles and concepts of the present invention and generally designated by the reference number 2 will be described.

Figure 1:
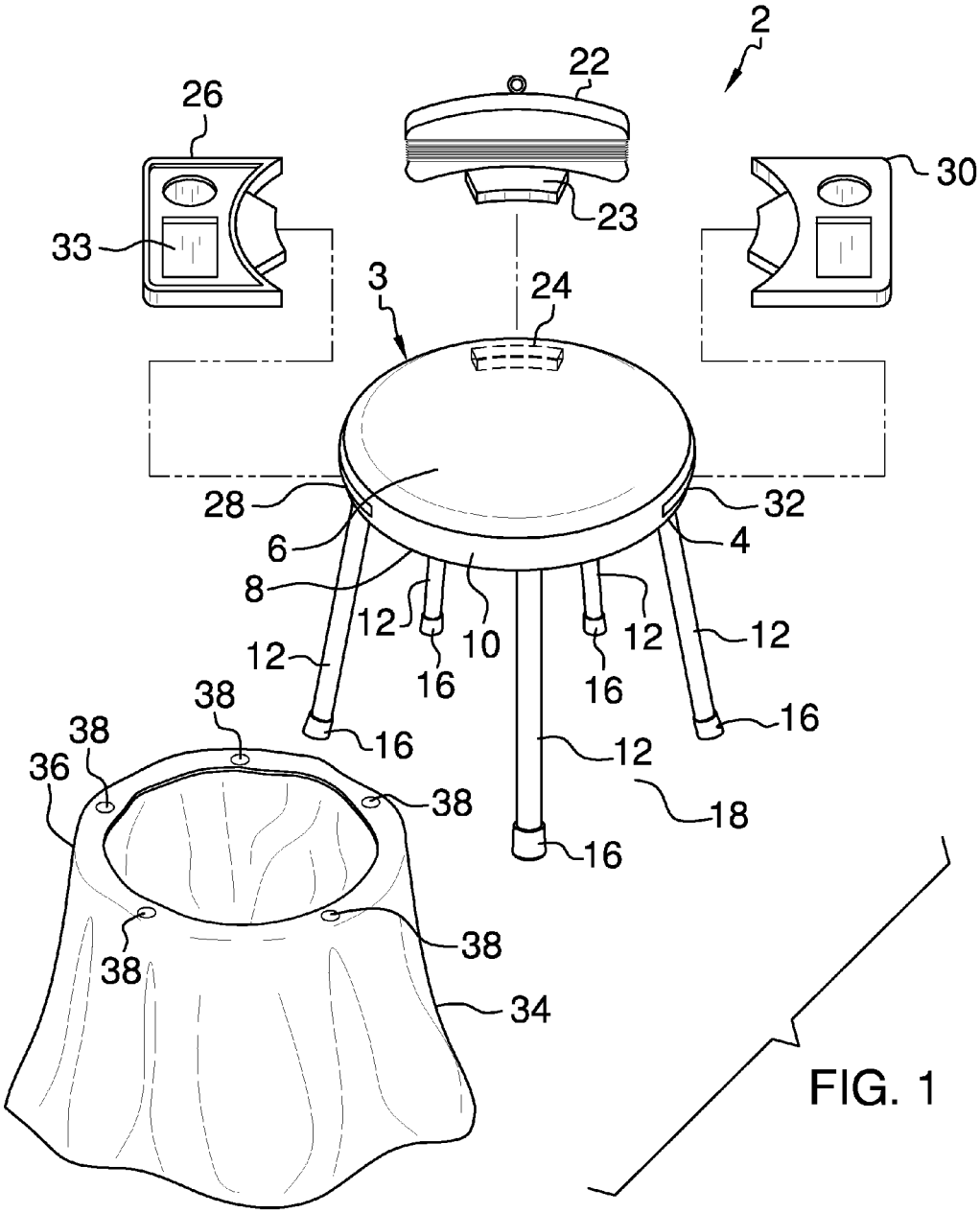
FIG. 1 is a perspective view of the various components of the exercise rest break stool.
Figure 2:
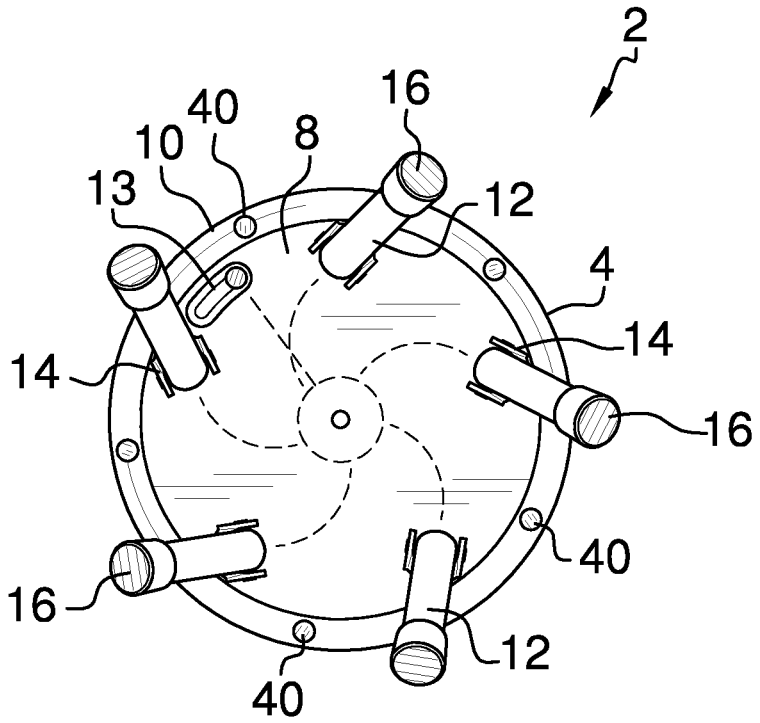
FIG. 2 is a bottom view showing a plurality of legs in an extended position.
Figure 3:
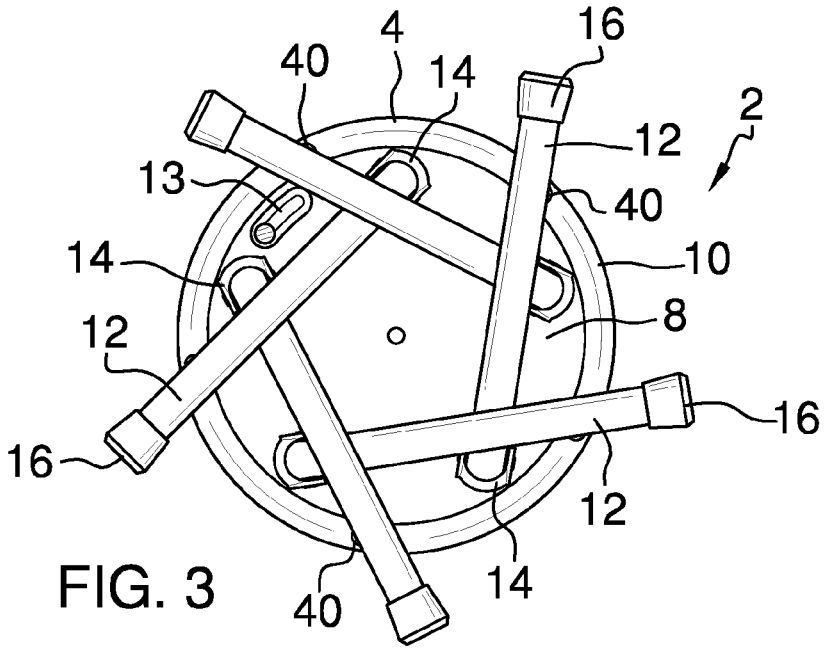
FIG. 3 is a bottom view showing the legs in a retracted position.
Figure 4:
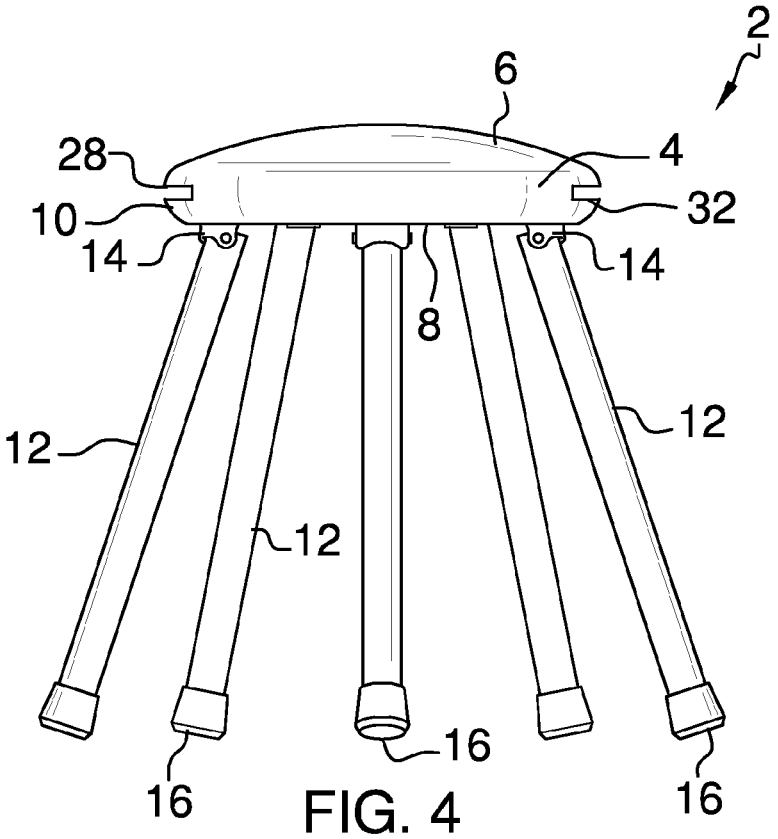
FIG. 4 is a side view showing the legs in the extended position.
Figure 5:
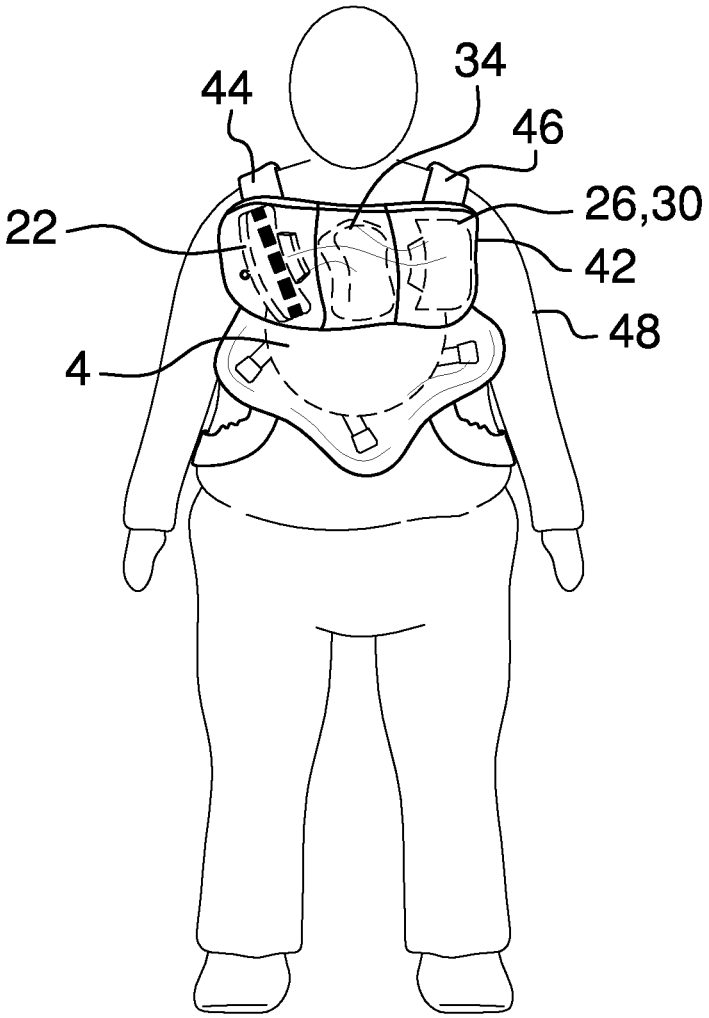
FIG. 5 is an in-use rear view showing a backpack holding a base being worn by a user.
Figure 6:
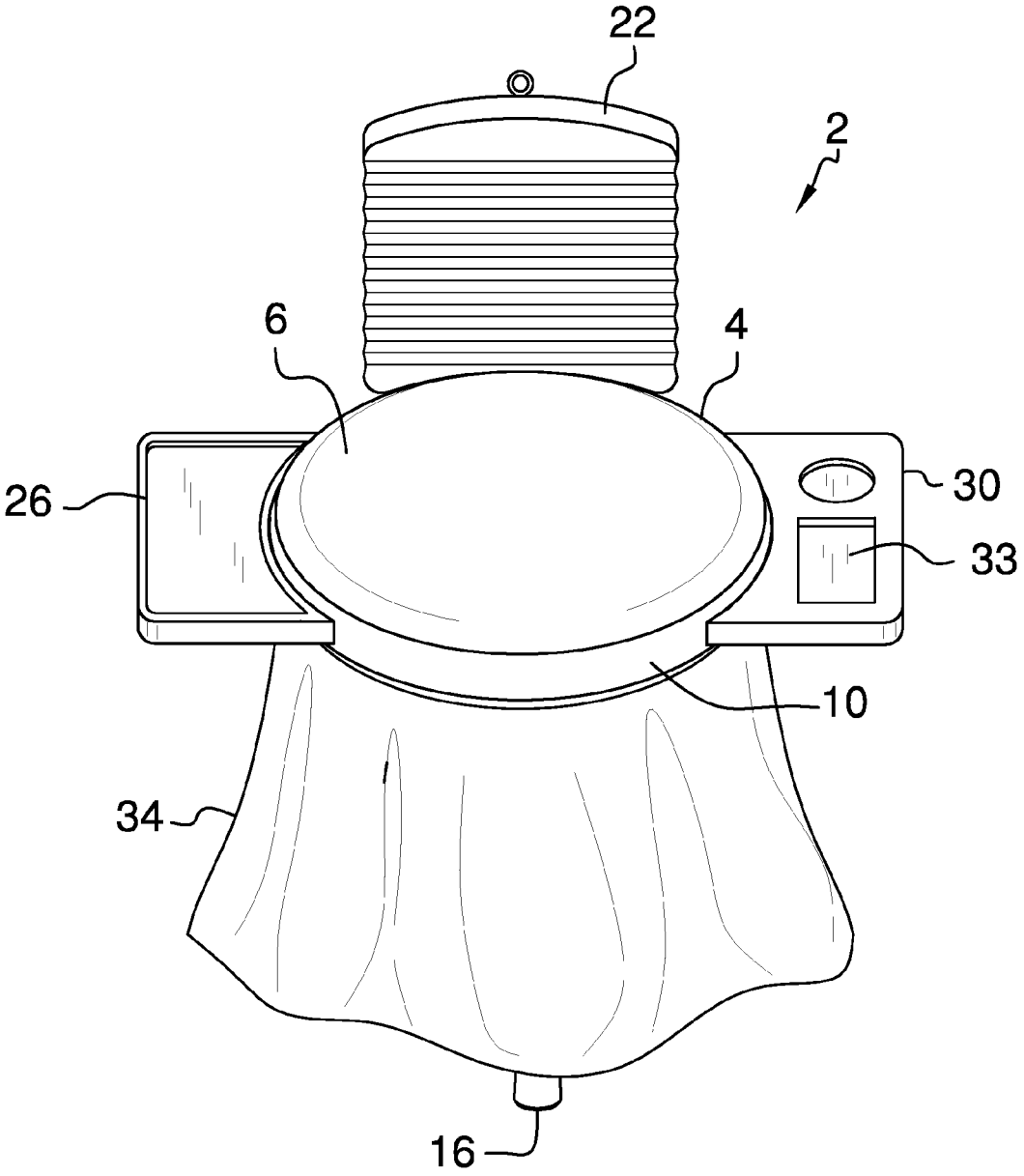
FIG. 6 is an in-use front perspective view in an assembled condition.

Referring to FIGS. 1 through 6, a preferred embodiment of the present invention is disclosed. The exercise rest break stool 2 disclosed herein includes a stool 3 including a disc-shaped base 4 that has an upper surface 6, a lower surface 8, and a continuous side surface 10 disposed between the upper surface 6 and the lower surface 8. A plurality of spring-loaded legs 12 is pivotally attached to the lower surface 8 of the base 4 via a hinge 14. A lock-release mechanism 13 disposed on the lower surface 8 is in operational communication with each leg 12 to release the legs from a folded position, as shown in FIG. 3, and to lock the legs 12 into an extended position, as shown in FIGS. 2 and 4 and vice versa. Each leg 12 has a slip-resistant foot grip 16 attached thereto to prevent slippage on a ground surface 18 during use. Preferably, five legs 12 are provided to permit the support of a user 48 who is overweight.

The device 2 also includes a backrest 22 which is attachable to the base 4. The backrest 22 has a frustoconical insertion member 23 which removably engages a backrest slot 24 disposed on the upper surface 6 of the base 4. The backrest 22 is configured to have a strength to allow the user 48 sitting on the base 4 of device 2 to rest his back against it. A left side slot 28 and a right side slot 32 are diametrically disposed to each other in the continuous side surface 10 in a position parallel to the upper surface 6 and on opposite sides of the backrest slot 24. Furthermore, a left tray portion 26 is removably insertable into the left side slot 28 and a right tray portion 30 is removably insertable into the right side slot 32. Each of the left and right tray portions 26, 30 includes at least one recess 33. The recess 33 is configured to hold items, such as a food item or a cup.

A skirt 34 is provided to hide the legs 12 when the device 2 is in use. The skirt 34 includes a support ring 36 centrally disposed on the skirt 34 and a plurality of spaced apart ring magnets 38 attached to the support ring 36, while a plurality of device magnets 40 are attached to the lower surface 8 of the base 4 proximal the side surface 10. To attach the skirt 34, an individual attaches each of the ring magnets 38 to a respective one of the device magnets 40.

When not in use, the components of the device 2 can be stored in a backpack 42, which includes a left strap 44 and a right strap 46, configured to be worn by the user 48. In use, the device 2 is devised to encourage an overweight or a disabled person to exercise regularly by encouraging the user to take the device along on walks or for other exercise activities to make the device 2 available wherever and whenever needed for a rest break. The base 4 and the legs 12 are configured to support the user 48 who is overweight.

What is claimed is:

1. An exercise rest break stool comprising:

a base having an upper surface, a lower surface, and a continuous side surface;

a plurality of hinges attached to the lower surface of the base;

a plurality of legs, wherein each leg is attached to one of the plurality of hinges;

a backrest slot disposed on the upper surface of the base;

a backrest having a frustoconical insertion member, wherein the insertion member removably engages the backrest slot;

a left side slot and a right side slot diametrically disposed to each other in the side surface in a position parallel to the upper surface and on opposite sides of the backrest slot;

a left tray portion and a right tray portion, wherein each of the left tray portion and the right tray portion is removably insertable into the left side slot and the right side slot respectively;

a skirt removably attached to the base lower surface;

a support ring centrally disposed on the skirt;

a plurality of spaced apart ring magnets attached to the support ring; and a plurality of device magnets attached to the lower surface of the base proximal the side surface, wherein each of the ring magnets is attachable to one of the device magnets;

wherein upon attachment of the ring magnet to the device magnet, the skirt is attached to the base.

2. The exercise rest break stool of claim 1 further comprising:

a plurality of slip-resistant foot grips, each foot grip attached to one of the legs;

wherein each foot grip is configured to prevent slippage on a ground surface during use.

3. The exercise rest break stool of claim 2 further comprising:

a backpack;

a pair of straps comprising a left strap and a right strap, each of the left strap and the right strap attached to the backpack, wherein each of the straps is configured to be placed over a user's shoulders;

wherein the backpack is configured to hold the base, the legs, the backrest, and the skirt.

4. The exercise rest break stool of claim 3 wherein the base is disc-shaped.

5. The exercise rest break stool according to claim 4 wherein the plurality of legs comprises five legs.

6. An exercise rest break stool comprising:

a base, the base having an upper surface and a lower surface, the base also having a continuous side surface, the base being circular;

a plurality of hinges pivotally attached to the lower surface of the base;

a plurality of spring-loaded legs, wherein each leg is attached to one of the hinges;

a lock-release mechanism disposed on the lower surface is in operational communication with each leg, wherein the lock-release mechanism releases each of the legs from a folded position and locks the legs into an extended position and vice versa;

a plurality of slip-resistant foot grips, each foot grip attached to one of the legs, wherein each foot grip is configured to prevent slippage on a ground surface during use;

a backrest slot disposed on the upper surface of the base;

a backrest having a frustoconical insertion member, wherein the insertion member removably engages the backrest slot;

a left side slot and a right side slot diametrically disposed to each other in the side surface in a position parallel to the upper surface and on opposite sides of the backrest slot;

a left tray portion and a right tray portion, wherein the left tray portion is removably insertable into the left side slot, further wherein the right tray portion is removably insertable into the right side slot;

a skirt removably attached to the base lower surface;

a support ring centrally disposed on the skirt;

a plurality of spaced apart ring magnets attached to the support ring;

a plurality of device magnets attached to the lower surface of the base proximal the side surface, wherein each of the ring magnets is attachable to one of the device magnets;

wherein upon attachment of the ring magnet to the device magnet, the skirt is attached to the base;

a backpack; and a pair of straps comprising a left strap and a right strap, each of the left strap and the right strap attached to the backpack, wherein each of the straps is configured to be placed over a user's shoulders;

wherein the backpack is configured to hold the base, the legs, the backrest, and the skirt.

7. The exercise rest break stool according to claim 6 wherein the plurality of legs comprises five legs.

* * * * *